US005974922A

United States Patent [19]

Camp et al.

[11] Patent Number: 5,974,922

[45] Date of Patent: Nov. 2, 1999

[54] HIGH RAKE KNIVES FOR COLOR PAPER SLITTING

[75] Inventors: Alphonse D. Camp, Rochester; John J. Seyna, Williamson, both of N.Y.; Keith W. Dorricott, Pinner, United Kingdom; Robert E. Deutsch, Rochester, N.Y.

[73] Assignee: Eastman Kodak Company, Rochester, N.Y.

[21] Appl. No.: 09/064,403

[22] Filed: Apr. 22, 1998

[51] Int. Cl.[6] ..... B26D 1/24

[52] U.S. Cl. ..... 83/37; 83/496; 83/500; 83/505

[58] Field of Search ..... 83/500, 496, 495, 83/505, 37, 13, 345, 948

[56] References Cited

U.S. PATENT DOCUMENTS

| | | | |
|---|---|---|---|
| 4,247,349 | 1/1981 | Detert et al. . | |
| 4,274,319 | 6/1981 | Frye et al. | 83/500 X |
| 4,640,165 | 2/1987 | McMahon et al. . | |
| 4,643,058 | 2/1987 | Zingler et al. | 83/501 X |
| 5,034,263 | 7/1991 | Maier et al. | 428/215 |
| 5,103,703 | 4/1992 | Littleton . | |
| 5,365,821 | 11/1994 | Munier et al. . | |
| 5,423,240 | 6/1995 | DeTorre | 83/500 |
| 5,761,980 | 6/1998 | Ima et al. | 83/500 |
| 5,794,500 | 8/1998 | Long et al. | 83/505 X |

FOREIGN PATENT DOCUMENTS

| | | |
|---|---|---|
| 0 737 552 A1 | 10/1996 | European Pat. Off. . |
| WO 97/11823 | 4/1997 | WIPO . |

*Primary Examiner*—Rinaldi I. Rada
*Assistant Examiner*—T. Anthony Vaughn
*Attorney, Agent, or Firm*—Paul A. Leipold

[57] ABSTRACT

The invention relates to a method of slitting photographic print material comprising providing at least one rotary anvil shearing device and at least one rotary knife shearing device wherein said at least one rotary knife has a rake angle of between about 50 and 70 degrees, and passing photographic material between said anvil and said knife to cut said material.

12 Claims, 2 Drawing Sheets

HIGH RAKE KNIVES FOR COLOR PAPER SLITTING

FIELD OF THE INVENTION

The invention relates to the cutting of photographic elements. It particularly relates to the cutting of color paper.

BACKGROUND OF THE INVENTION

During the manufacturing of color paper it is necessary to cut the material lengthwise prior to its exposure, to reach suitable size for customer use. The photographic paper is formed in long, wide sheets, then spooled into large rolls. These rolls must be slit to suitable widths in a very accurate manner. It is important that the slitting be performed without damage to the sensitive photographic materials that are on the paper substrate. Further, it is important that slitting be performed without creation of substantial dust which might lead to undesirable contamination of picture surfaces after development.

Generally the knives utilized for cutting photographic papers have been arrangements of circular knives on shafts, with the paper being fed between the shafts with knives. The circular knives are brought together such that they touch and overlap slightly at the edge. It is common for one knife to have a square edge called the female knife, and the other knife to be ground at some angle, this knife called a male knife. In this way, many strips can be simultaneously slit from a wide sheet. U.S. Pat. No. 5,365,821—Munier et al discloses such a cutting device. EP 0 737 552—Blandin also discloses a knife and anvil cutting device.

The male circular knife generally has been applied to the upper or photosensitive side of the paper during slitting with the female knife in contact with the other side. However, in some instances, the reverse has been practiced. Typically the knife blade previously used has had a low rake angle, 10–15 degrees, ground on the edge, the low angle was used because it was an improvement over a square edge with no rake, and a mid range angle, such as 30 to 45 degrees.

In some instances, there has been found to be discoloration, such as yellow dye formation on the cut edge of photographic pictures after development. Further, there is a continuing problem with dirt and debris generated during cutting that will contaminate images during development.

PROBLEM TO BE SOLVED BY THE INVENTION

There is a need to provide cutters that generate less dust, and there is a need to minimize edge staining of color paper that is apparent after exposure and development.

SUMMARY OF THE INVENTION

An object of this invention is to provide improved cutting of photographic paper.

Another object of the invention is to provide a cutting method that results in less dust being present on the photographic element.

A further additional object is to provide a method of cutting that results in minimized edge staining of color prints after development.

These and other objects of the invention are generally accomplished by a method of slitting photographic print material comprising providing at least one rotary anvil shearing device and at least one rotary knife shearing device when said at least one rotary knife has a rake angle of between about 50 and 70 degrees, and passing photographic material between said anvil and said knife to cut said material.

ADVANTAGEOUS EFFECT OF THE INVENTION

This invention has the advantage that cutting of color paper is accomplished rapidly with low generation of dust and substantially no edge defects in the pictures developed utilizing the cut material.

DETAILED DESCRIPTION OF THE INVENTION

The invention has numerous advantages over prior cutting methods. The invention results in less dust being generated during cutting. Further, the invention provides cutters that are longer lasting and require fewer changes while retaining good cutting properties. The cutting method of the invention provides smoother edges and more asthetically desirable photographs. The cutters of the invention further result in minimizing of side defects in cut photographic paper such as yellow edge staining and frayed edges. These advantages of the invention will be apparent from the detailed description below.

In some instances, there has been found to be discoloration, such as yellow dye formation at the cut edge of photographic prints, after development. During the slitting process, very high pressures occur along the edge due to the action of the knives, which in turn can result in a colored edge. The color and width can vary depending on the emulsion coating, the type of paper, or the rake angle of the male knife. Further, there is an ongoing problem with debris generated during slitting that may contaminate the print surfaces during development. There is a need to provide circular knives that result in smooth slit edges, generate less debris, and minimize edge coloration after exposure and development.

Figure 1:
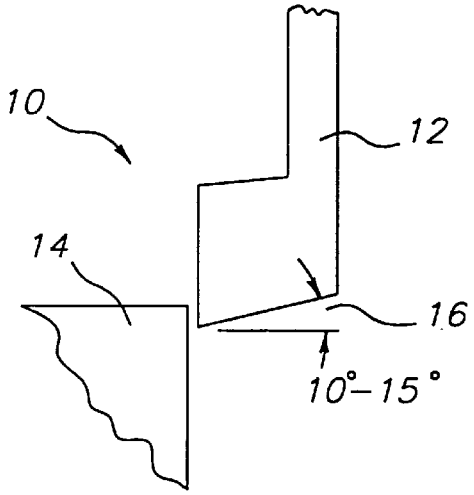
FIG. 1 (PRIOR ART)
FIG. 1 is a schematic illustration of prior art low rake angle slitter knives.

FIG. 1 is a schematic illustration of cutting apparatus 10 of the prior art comprising an upper male knife 12 and lower female knife 14. There is illustrated at 16 the low rake angle of about 10–15 degrees from horizontal utilized with the prior art knife.

Figure 2:
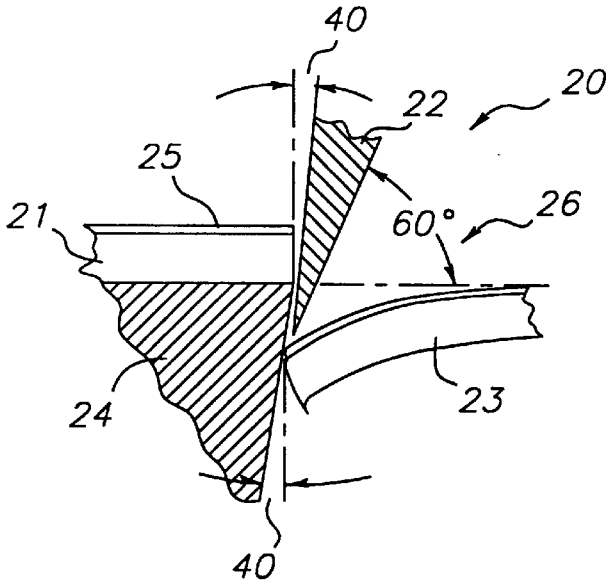
FIG. 2 is a schematic illustration of the slitter knives in accordance with the invention.

FIG. 2 illustrates apparatus 20 of the invention method. In apparatus 20 upper knife 22 is held against lower knife 24. There is illustrated the rake angle 26 of 60 degrees which is preferred for the method of the invention. The apparatus 20 is illustrated in the moments after shear of a sheet of the supported color paper 21 that is composed of a base 23 and emulsion layers 25. The paper 21 is supported on female knife 24 during cutting by knife 22 when unsupported color paper 23 is separated. The knife is illustrated as having a slight relief angle (face angle) 40 of 1 to 6 degrees.

Figure 3:
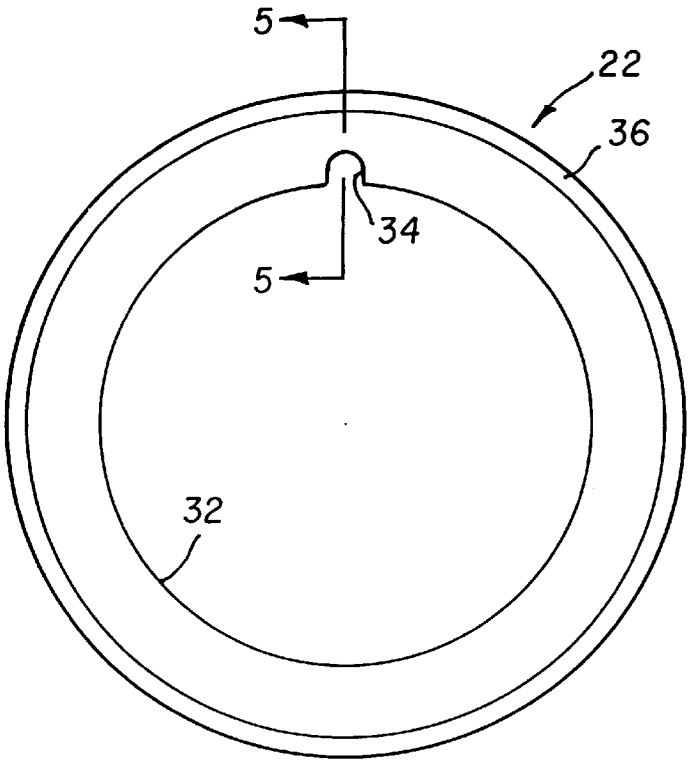
FIGS. 3 and 4 show front and side views of a typical invention circular slitter knife.
Figure 4:
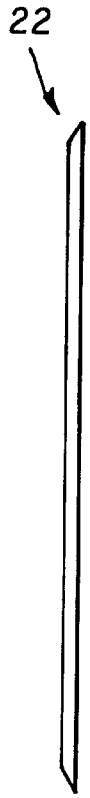
Figure 5:
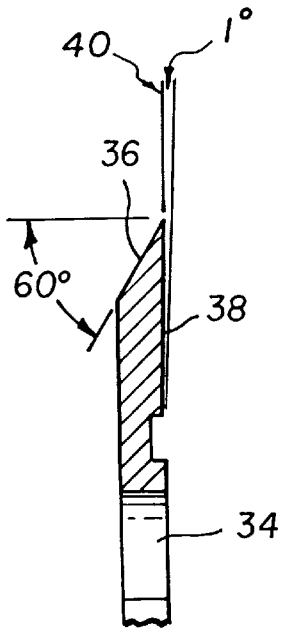
FIG. 5 shows a section through the circular slitter knife of FIG. 3 at section line 5—5.

FIGS. 3, 4, and 5 show a typical knife in accordance with the invention. FIG. 3 shows a front view with a vacant center area 32, used to mount onto a knife carrier, which is then slid onto a knife shaft, and secured in position. Keyway 34 is used to prevent knife rotation on the knife carrier. The knife and knife carrier are held firmly on the knife shaft, which then rotates at the correct speed. FIG. 5 is a section of line 5—5; the rake angle is formed by the position of surface 36 relative to the horizontal. The rake angle generally is between 50 and 70 degrees. The opposite side of the knife, surface 38, generally has a small angle, called a face angle, or relief angle. This angle is always a positive angle, that is, the angle is ground into the knife face, typically less than 6 degrees. In some cases, however, no angle is used, and the face is perpendicular to the horizontal.

The invention style slitter knives are usually arranged in series on a knife shaft or knife bar. To such shafts, one male, another female, are mounted near each other, and then brought together, with the knives overlapping each other slightly. The faces of the male and female knives are then brought in to touch. A specific load is then applied to the end of one shaft, called the end load or preload, to ensure that the male and female knives remain in contact. This load is in the range of 2–5 pounds depending on knife style. The paper sheet is then drawn between the two shafts and knife pairs. As the shafts rotate and the paper is pulled, individual strips of paper result. The overlap of the slitter knives is generally 0.015" to 0.060". On some machines, there are no knife shafts; the knives are mounted in pairs in separate modules that each holds one male and one female. These knives are contained and generally fixed, except that they are allowed to rotate.

Tests have shown that the preferred method for slitting is the emulsion side of the paper facing toward the male knives, although good results can also be achieved with the paper backside toward the male knife.

The male knife shaft with knives is generally preferred to be rotated a bit faster than the paper that moves through the knives. This is called the overdrive, or overspeed. Overdrives of 2–5% are preferred. Female knife shafts generally rotate at the same speed as the paper, or just slightly faster.

The slitter knives of the prior art do not cut cleanly through the paper. The paper edge is similar to a tear, with paper fibers hanging on the edge, and the coatings protruding after being stretched. The knives of the invention will cut through the same paper but minimize the paper fibers on the edge, and the stretching of the coatings, thus reducing debris, and giving a better appearance. Further, the emulsion coatings are less stressed and so the edge is not as badly deformed. The high rake knives concentrate the slitting forces into a very narrow band along the edge, and so edge discoloration is minimized and confined to this narrow region. It is surprising that after many years of cutting with low rake knives, the change to a high rake knife has resulted in this improvement. The improvement in edge staining is particularly noticeable with color papers containing emulsions that are high chloride emulsions with Bromide at or near the surface.

It has also been shown that too high a rake angle also is harmful to proper cutting of color photographic paper. At angles of greater than 70 degrees, the knife edge becomes extremely fragile and is easily damaged, prone to cracking, and more difficult to manufacture consistently.

The following examples illustrate the practice of this invention. They are not intended to be exhaustive of all possible variations of the invention. Parts and percentages are by weight unless otherwise indicated.

EXAMPLES

Example 1

In order to illustrate the advantage of the 60 degree rake of the cutting knife, a series of tests was run. A series of 40° and 60° rake circular knives was arranged and then run at two different speeds and two different tensions and two different wraps were varied as set forth in Table 1 below. Tension is the draw force of the color paper. Wrap is the angle in degrees that the paper wraps around a knife bar, measured from the perpendicular of the male/female knife bar centerlines.

TABLE 1

| RUN | RAKE | SPEED (fpm) | TENSION | WRAP |
|---|---|---|---|---|
| 1 | 40 | 1750 | 4 lb. | 0° |
| 2 | 40 | 1750 | 4 lb. | 90° |
| 3 | 40 | 1750 | .75 lb. | 0° |
| 4 | 60 | 1750 | 4 lb. | 0° |
| 5 | 60 | 750 | 4 lb. | 90° |
| 6 | 60 | 750 | 4 lb. | 0° |
| 7 | 60 | 1750 | .75 lb. | 90° |
| 8 | 60 | 1750 | 4 lb. | 90° |
| 9 | 60 | 1750 | .75 lb. | 0° |
| 10 | 40 | 1750 | .75 lb. | 90° |
| 11 | 40 | 750 | 4 lb. | 90° |
| 12 | 40 | 750 | .75 lb. | 0° |
| 13 | 40 | 750 | 4 lb. | 0° |
| 14 | 60 | 750 | .75 lb. | 90° |
| 15 | 60 | 750 | .75 lb. | 0° |
| 16 | 40 | 750 | .75 lb. | 90° |

Experiment Description:

This slitting experiment consisted of slitting Ektacolor Royal III in a full factorial designed experiment. This resulted in 16 different slitting conditions. Refer to Table 1 above for the full layout of the experiment. The slitting conditions were:

| | |
|---|---|
| Upper (male) knife rake | 40° & 60° |
| Slitting speed | 750 fpm & 1750 fpm |
| Web tension | 75 lb. and 4.0 lb. |
| Wrap angle through knives | 0° & 90° |

Other fixed slitting parameters for the experiment were:

| | |
|---|---|
| Lower and upper knife sharpness | .0001" rad max |
| Knife preload | .010" |
| Overdrive | 2.50% |
| Knife overlap | .030" |
| Relief (face) angles | +1° |
| How slit | Emulsion side up |

One 35 mm strip was slit out of the center of a 2.50" web for all treatment combinations. After slitting, the strips were tested for slit edge dust. The results of these tests were that the 60 degree rake knives produced an edge that had less dust. Testing with tacky tape indicated that the dust level of the edges was at least ⅓ less at 60 degree rake than at 40 degree rake. Previous tests at the conventional about 12 degree rake had indicated an even higher dust content than at 40 degree rake.

Visual examination of the edges of the cut strips indicated that the edges were much smoother for the 60 degree rake than for the 40 degree rake. Previous tests indicated 12 degree rake to be worse for dust than 40 degree rake.

Tests with developed pictures having white edges indicated that there was minimal or no yellow edge stain on those cut with the 60 degree rake, whereas those with the 40 degree rake showed some staining, although comparison with previous experiments shows it to be less than that with the 12 degree rake knife.

The other parameters, speed and tension, were indicated as having very little effect upon dust generation, slit edge quality, or picture edge staining. Therefore, these tests indicate that the 60 degree blade is much preferred.

The invention has been described in detail with particular reference to certain preferred embodiments thereof, but it will be understood that variations and modifications can be effected within the spirit and scope of the invention.

What is claimed is:

1. A method of slitting photographic paper print material comprising providing at least one rotary anvil shearing device and at least one rotary knife shearing device wherein said at least one rotary knife has a rake angle of between about 50 and 70 degrees, and passing photographic paper material between said anvil and said knife to cut said material, wherein said at least one knife overlaps said anvil roll by 0.015 to 0.060 inches and wherein said knives are driven at about 2 to 5 percent greater than said print materials speed.

2. The method of claim 1 wherein said rake angle is about 60 degrees.

3. The method of claim 1 wherein said at least one rotary knife is mounted on a shaft and said at least one anvil knife is mounted on a shaft and the print material is fed between said shafts.

4. The method of claim 1 wherein the lateral force of said knife against said anvil is between 9 and 23 Newtons.

5. The method of claim 1 wherein said photographic member is positioned in cutting such that the knife contacts the emulsion side of said print material.

6. The method of claim 4 wherein the relief angle is a positive angle of between 1 and 6 degrees.

7. The method of claim 1 wherein said photographic member is positioned in cutting such that the knife contacts the backside of said print material.

8. A method of slitting photographic print material comprising providing at least one rotary anvil shearing device and at least one rotary knife shearing device wherein said at least one rotary knife has a rake angle of between about 50 and 70 degrees, and passing photographic paper material between said anvil and said knife to cut said material wherein the said rake angle is about 60 degrees and wherein said knives are driven at about 2 to 5 percent greater than said print materials speed.

9. The method of claim 8 wherein said at least one knife overlaps said anvil roll by 0.015 to 0.60 inches.

10. The method of claim 9 wherein said at least one rotary knife mounted on a shaft and said at least one anvil knife is mounted on a shaft and the print material is fed between said shafts.

11. The method of claim 9 wherein the lateral force of said knife against said anvil is between 9 and 23 Newtons.

12. The method of claim 10 wherein the relief angle is a positive angle of between 1 and 6 degrees.

* * * * *